United States Patent [19]

Seidel et al.

[11] Patent Number: 4,593,707

[45] Date of Patent: Jun. 10, 1986

[54] VARIABLY VENTILATED FILTER CIGARETTE

[75] Inventors: Henning Seidel, Lueneburg; Wolfgang Wildenau, Hamburg; Joachim Mantke, Hitzhusen, all of Fed. Rep. of Germany

[73] Assignee: H.F. & Ph.F. Reemtsma GmbH & Co., Hamburg, Fed. Rep. of Germany

[21] Appl. No.: 744,765

[22] Filed: Jun. 14, 1985

[30] Foreign Application Priority Data

Jun. 20, 1984 [DE] Fed. Rep. of Germany ..... 3422776
May 10, 1985 [DE] Fed. Rep. of Germany ..... 3516841

[51] Int. Cl.[4] ..... A24D 3/00; A24D 1/04

[52] U.S. Cl. ..... 131/336; 131/338; 131/198.2

[58] Field of Search ..... 131/336, 338–340, 131/198.1, 198.2

[56] References Cited

U.S. PATENT DOCUMENTS

| | | | |
|---|---|---|---|
| 3,359,988 | 12/1967 | Thomson | 131/336 |
| 3,376,874 | 4/1968 | Yunil Kim et al. | 131/338 |
| 3,428,050 | 2/1969 | Kandel | 131/338 |
| 3,503,406 | 3/1970 | Riegel et al. | 131/336 |
| 3,512,537 | 5/1970 | Louis . | |
| 4,481,959 | 11/1984 | Byrne | 131/336 |

FOREIGN PATENT DOCUMENTS

| | | |
|---|---|---|
| 0105683 | 9/1983 | European Pat. Off. . |
| 0105682 | 9/1983 | European Pat. Off. . |

*Primary Examiner*—Vincent Millin
*Assistant Examiner*—H. Macey
*Attorney, Agent, or Firm*—Cushman, Darby & Cushman

[57] ABSTRACT

A variably ventilatable filter cigarette is provided with a filter body having a plurality of spaced circumferential, peripheral channels covered by a wrapping sheet at least a portion of which is air permeable, the wrapping sheet extending beyond the filter body to receive a cup-shaped member having an end wall with perforations alignable with the channels; the cup-shaped member is rotatable to vary the degree of registration with respect to the channels.

14 Claims, 10 Drawing Figures

VARIABLY VENTILATED FILTER CIGARETTE

Figure 1A:
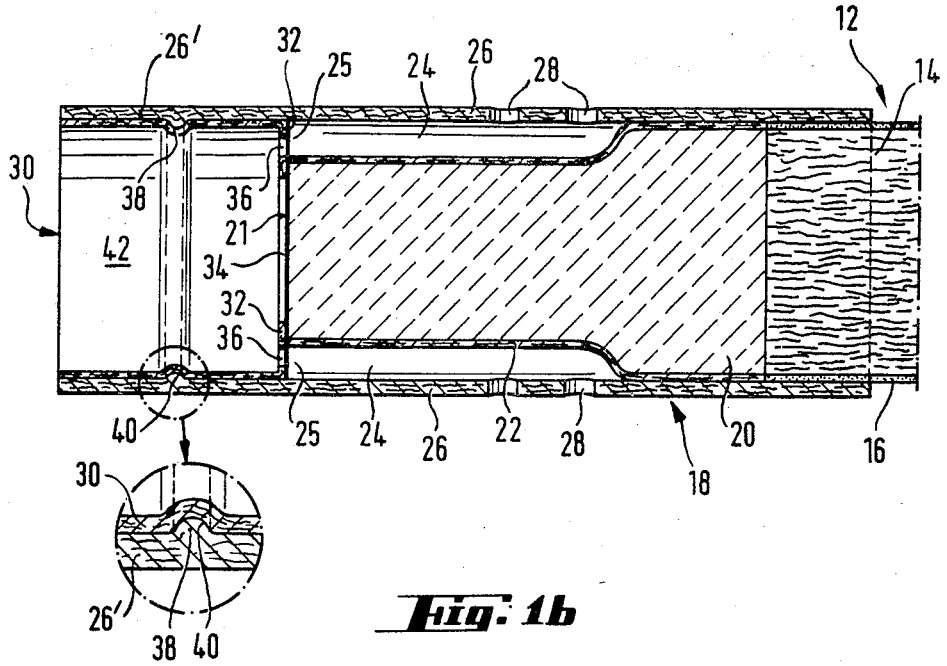

The invention relates to a variably ventilatable filter cigarette with a grooved filter according to the preamble of the main claim.

Such filter cigarettes were known from DE-OS 30 11 959 and lead to a strict separation between the smoke stream and the ventilation air and mixing thereof only takes place in the smoker's mouth.

The proportion of ventilation or secondary air is, in the case of such ventilated filter cigarettes, dependent on a number of factors, e.g. the permeability to air of the wrapper sheet, i.e. the number and size of the perforations and the number and size of the channels in the grooved filter, i.e. the filter resistance and the barrier resistance of the tobacco rod which varies as the cigarette burns away.

In each case desired secondary air range can admittedly be obtained by carefully matching these parameters, in that e.g. larger grooves are provided in the grooved filter for increasing the secondary air proportion and providing the wrapping sheets with correspondingly more permeable perforations. However, such changes to the degree of ventilation are complicated, and make cigarette manufacture much more difficult.

U.S. Pat. No. 3,390,684 discloses a filter cigarette, in which the ventilation air stream can be regulated either by covering a ventilation opening with a finger or a fitted sleeve. However, the inadequate variability of the ventilating air stream supplied and secondly the difference in the external appearance compared with conventional filter cigarettes is disadvantageous. Furthermore, U.S. Pat. No. 3,376,874 discloses rotatably arranged cup-shaped sleeves for cigarette filters, by means of which the smoker can influence the filtering action as a function of the degree of turning. However, such regulatable filters with cup-shaped sleeve can only be manufactured in a complicated manner and also modify the usual behaviour of a conventional filter cigarette. All these known filters also suffer from the disadvantage that they have no ventilation air stream guidance which is strictly separated from the smoke stream.

The object of the present invention is to develop a variably ventilatable filter cigarette of the aforementioned type with a plurality of ventilation channels separated from the smoke stream which, as a function of the instantaneous smoking habits of the consumer can be reproducibly set by the latter to increased or decreased ventilation and without any modification of the aroma quality. In addition, the appearance of such a filter cigarette in its outer circumferential area does not differ from that of a conventional filter cigarette and finally it can be manufactured in a simple, conventional manner.

According to the invention this object is obtained by providing a ventilated filter cigarette with a grooved filter, which comprises a solid cylindrical filter body with an air-impermeable sleeve surrounding the same and on whose circumferential surface are arranged in spaced manner a plurality of substantially axial, mouth-side open and tobacco-side closed groove-like channels and in which the filter body and the filter side end of the tobacco portion are surrounded by a wrapping sheet, which, at least in the vicinity of the groove-like channels is permeable to air and which is characterized by a sleeve connected to the mouth-side end of the grooved filter, which is constructed in cup-shaped manner and rotatably arranged in the wrapping sheet which is extended over and beyond the grooved filter, said sleeve having a base surface with a central opening engaging on the end face of the grooved filter and openings or recesses in the edge area and said openings or recesses in the edge area can be brought from a through position into a partly or completely closed position with the outlets of the groove-like channels by turning the sleeve.

Surprisingly, this combination not only leads to the smoker having a simple variation possibility by a mere rotary movement, but only the secondary air led through the grooves of the grooved filter can be closed or reduced. There is no change as regards flavor and aroma to the main smoke stream, because the quality thereof is only influenced by the given filter part. The regulation of the secondary air only influences the concentration of the main smoke stream in the sense of a "milder" or "stronger" cigarette, while retaining the aroma.

Preferably, the filter cigarette according to the invention is so constructed that the cup-shaped sleeve is held in rotary engagement in the extended wrapping sheet by means of an annular slot, which is located on the outer face of the cup-shaped sleeve and an annular spring engaging in the slot and which is positioned on the inner face of the extended wrapping sheet.

In a further embodiment of the invention, the variably ventilatable filter cigarette can be constructed in such a way that the inner area of the cup-shaped sleeve is partially or wholly filled with filter material.

This additional filling with filter material may be provided by means of a filter plug or a grooved filter. In the case of an additional grooved filter in the cup-shaped sleeve, no qualitative differences in the main smoke stream occur, provided that these grooves are aligned with the grooves of the solid cylindrical filter body and particularly if said grooves are sealed with respect to the filter plug in the sleeve. However, the qualitative action can be influenced if the main smoke stream is allowed to flow through the filter plug in the cup-shaped sleeve, either by turning the sleeve which prevents the alignment of the channels and/or by a desired permeability for the secondary air flow from the channels of the grooved filter plug in the sleeve and into said plug, in order to obtain a concentration and mixing of the secondary air and the main smoke stream in said filter.

In the case of the aforementioned filter cigarettes, the rotary sleeve at the mouth-side end can e.g. be turned into the appropriate position by inserting a pin or by using the small finger.

To enable the filter cigarette to be improved in such a way that the adjustment of the rotary, cup-shaped sleeve can be provided in a simple manner by gripping from the outside, while simultaneously scarcely or not changing the external behavior of said filter cigarette, it is proposed that the cup-shaped sleeve has a sleeve-like extension on the mouth side beyond the extended wrapping sheet.

It has surprisingly been found that this sleeve-like extension can be held much more easily with the fingers from the outside in order to turn the cup-shaped sleeve into the desired position and that there is also no change to the external appearance of the cigarette, because the external diameter of the sleeve-like extension is only very slightly smaller, namely by the thickness of the extended wrapping sheet.

According to a particularly preferred embodiment, this minor difference in the external diameter can be compensated for in that the sleeve-like extension in the area no longer covered by the extended wrapping sheet, following a bend on passing out of the extended wrapping sheet, has the same external diameter as the grooved filter surrounded by said sheet and is aligned therewith.

According to a further advantageous embodiment, the sleeve-like extension, independently of whether it has a cylindrical ring of the same diameter or such a ring with a bent region, is covered with a further wrapping sheet in the projecting region no longer covered by the extended wrapping sheet.

According to a particularly preferred embodiment, this further wrapping sheet, applied to the projecting portion of the cup-shaped sleeve or the sleeve-like extension, can be connected to the extended wrapping sheet by means of and at a preset breaking point. This embodiment not only has the advantage that the wrapping sheet in the vicinity of the grooved filter and the extended wrapping sheet in the vicinity of the cup-shaped sleeve and also the further wrapping sheet optically form a uniform, smooth surface, but also the manufacture of such a filter cigarette is considerably simplified, because only a single wrapping sheet with a preset breaking point is placed in one operation around the grooved filter, the cup-shaped sleeve and the sleeve-like extension.

Only by briefly turning in the vicinity of the sleeve-like extension does the consumer have to force open the preset breaking point, in order to set the desired ventilation action by turning.

With a view to facilitating turning of the sleeve and the adjustability of the ventilation air, it is also advantageous if blocking means are provided on the extended wrapping sheet and on the rotary sleeve, to permit only a limited movement of the rotary sleeve from a position in which the openings or recesses in the edge area of the base surface are moved with the outlet openings of the groove-like channels in the through position into a closed position. Preferably the blocking means comprise a part ringshaped projection or a nose engaging in a part ringshaped slot, it also being possible to arrange a plurality of reciprocally shaped noses, which engage in corresponding part ring-shaped slots.

According to a particularly preferred embodiment, it is possible to provide markings indicating the full passage position and/or closed position of the ventilation air on the outer face of the sleeve-like extension or on the further wrapping sheet covering the same and on the outer face of the extended wrapping sheet.

Figure 1B:
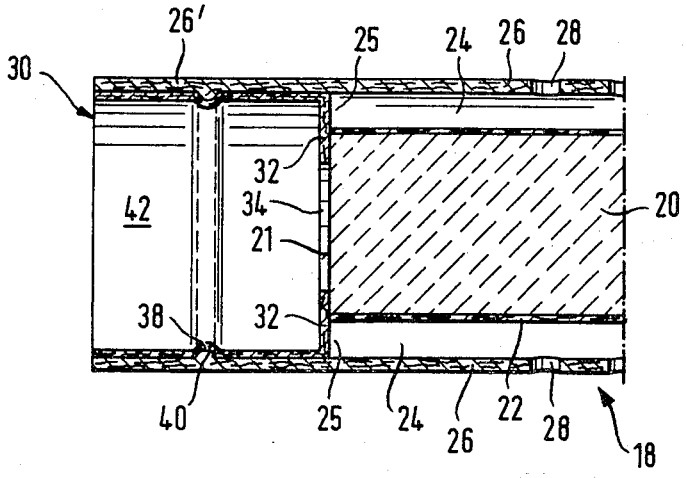
Figure 2:
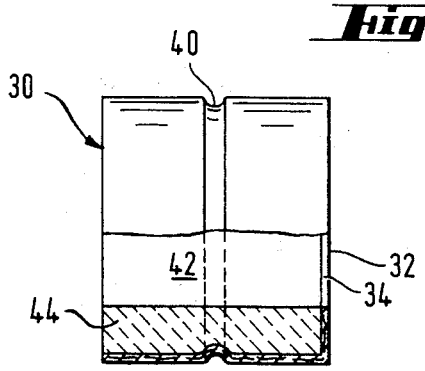
Figure 3A:
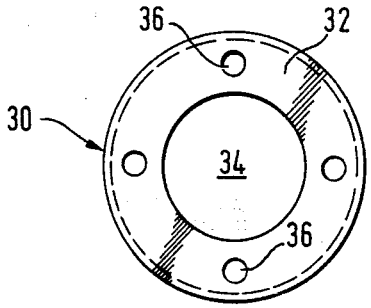
Figure 3B:
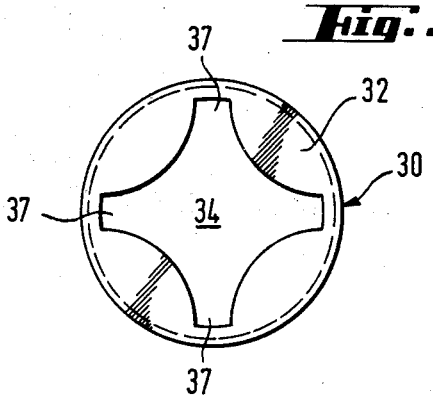
Figure 4:
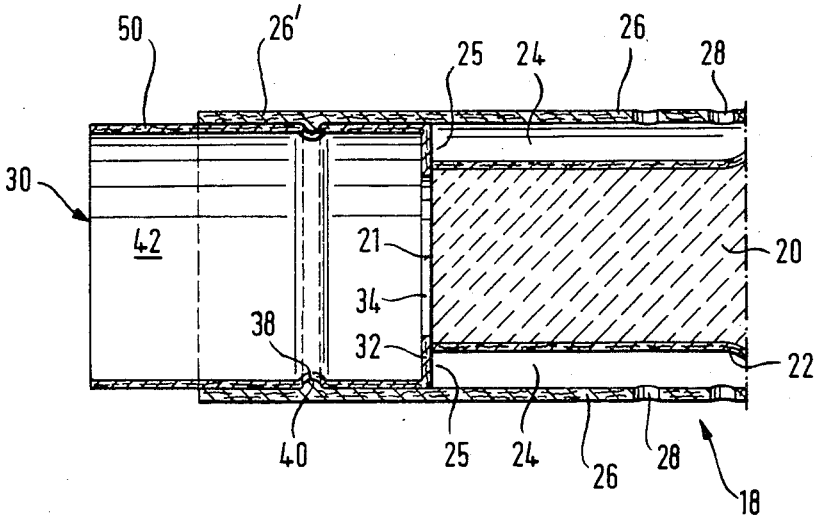
Figure 5:
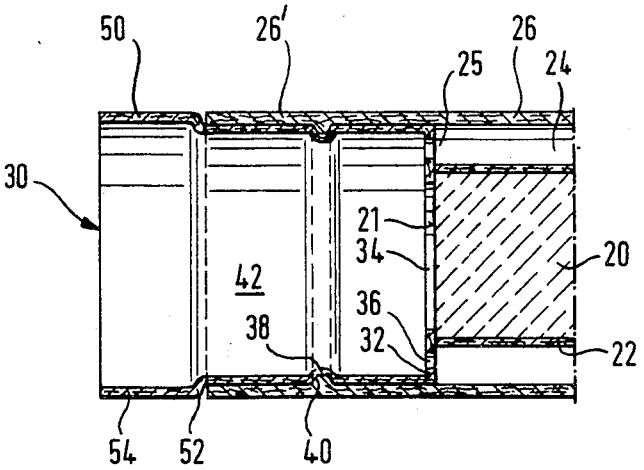
Figure 6:
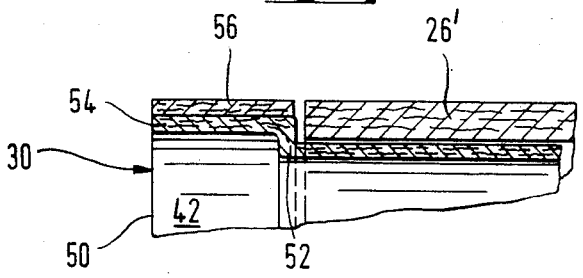
Figure 7:
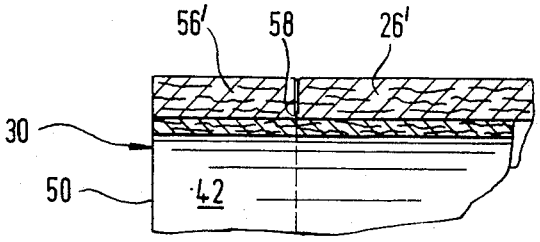
Figure 8:
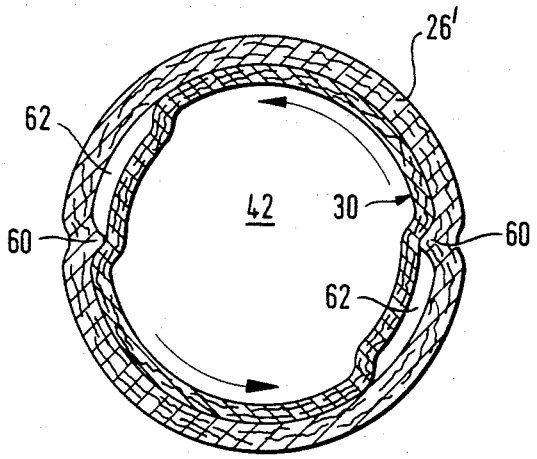

The invention is described in greater detail hereinafter relative to the drawings, wherein show:

FIG. 1*a* a longitudinal section through the filter cigarette according to the invention with complete ventilation;

FIG. 1*b* a partial longitudinal section identical to FIG. 1*a* with closed ventilation;

FIG. 2 a part sectional view of the cupshaped sleeve;

FIG. 3*a* a view of the bottom of the cupshaped sleeve;

FIG. 3*b* a view identical to FIG. 3*a* of a modified bottom;

FIG. 4 a partial longitudinal section through a modified filter cigarette with projecting cup-shaped sleeve;

FIG. 5 a partial longitudinal section through the mouth-side area of the filter cigarette according to the invention similar to FIG. 4 with complete ventilation;

FIG. 6 a partial section through a further construction of the sleeve-like extension of the rotary cup-shaped sleeve with a bent portion;

FIG. 7 a partial section similar to FIG. 6, in which the further wrapping sheet is connected to the extended wrapping sheet via a preset breaking point; and FIG. 8 a vertical section through the filter cigarette mouthpiece in the vicinity of the cupshaped sleeve with blocking means.

In the case of the filter cigarette shown in FIG. 1, a tobacco portion 12 with a tobacco rod 14 and a paper sleeve 16 for the same are provided. The grooved filter 18 comprises a cylindrical filter body 20 with an air-impermeable sleeve 22, in whose circumferential surface are formed groove-like channels 24. This grooved filter 18 is surrounded by a wrapping sheet 26, in which perforations 28 are provided in the vicinity of the channels 24.

The channels are open towards the mouth-side end and closed towards the tobacco-side end.

The secondary air flows through the perforations 28 and channels 29 and passes through the outlets 25 of the groove-like channels 24 into the smoker's mouth separately from the smoke flowing through the grooved filter core 20.

A cup-shaped sleeve 30 held in a rotatable manner by an extended wrapping sheet 26' is placed at the mouth-side end of grooved filter 18. As shown in FIG. 2, the cup-shaped sleeve has a ring-like all-round slot 40, in which engages a ring-like, all-round projection 38 provided on the inner face of the extended wrapping sheet 26'. As a result of this arrangement, the cup-shaped sleeve 30 can be rotated about its longitudinal axis, but is secured against slipping out. The bottom surface 32 of the cup-shaped sleeve 30 has, as shown in FIG. 3*a*, different openings and namely a central opening 34 in the vicinity of the end face 21 of the grooved filter and also openings 36 in the edge area of bottom surface 32, which are aligned with the outlets 25 (FIG. 1*a*) of the groove-like channels 24.

Openings 36 can either be constructed as separate openings (FIG. 3*a*) or as recesses, as shown in FIG. 3*b*, where the recesses 37 in the edge area merge with the central opening.

By relative rotation of the cup shaped sleeve, it is possible to obtain two extreme ventilatability cases. In the case of FIG. 1*b*, the bottom surface 32 of the cup-shaped sleeve 30 is turned in such a way that the bottom surface comes to rest over the outlets 25 of the groove-like channels 24, in which position an access of secondary air and consequently ventilation is prevented.

In the case of FIG. 1*a*, the openings 36 in the edge are of bottom surface 32 are aligned with the outlets 25 of the groove-like channels 24, so that secondary air can flow through channels 24 in unimpeded manner into the cup-shaped sleeve 30, where it can mix with the already filtered smoke, which enters the inner area 42 of said sleeve through filter body 20 and the central opening 34 in the bottom 32 of the cup-shaped sleeve. The inner area 42 of the cup-shaped sleeve can optionally contain further filter material either partly, e.g. as a filter ring 44 (FIG. 2) or completely.

In the embodiment shown in FIG. 4, the cup-shaped sleeve 30 is extended on the mouth side in the extended wrapping sheet 26' and forms a sleeve-like extension 50 extending beyond the wrapping sheet 26'. This construction makes it possible to set the desired ventilation by lightly gripping the projecting, sleeve-like extension with the fingers.

As in the case of this embodiment, there is a slight offset between the projecting portion of the sleeve-like extension 50 and the extended wrapping sheet 26', so that the optical appearance of the cigarette is slightly changed, according to the preferred embodiment of FIG. 5 in the area no longer covered by the extended wrapping sheet 26', the sleeve-like extension 50, following a bend 52 corresponding to an increase in diameter, is widened somewhat on passing beyond the extended wrapping sheet 26', portion 54 of the projecting sleeve-like extension 50 having to a greater or lesser extent the same external diameter as the grooved filter 18 surrounding the wrapping sheet 26 and is more aligned therewith.

The external diameters of the two parts can be the same or differ slightly.

In the case of a particularly preferred embodiment as shown in FIG. 6, the sleeve-like extension 50 in the area no longer covered by the extended wrapping sheet 26', i.e. in the projecting area 54, is covered by a further wrapping sheet 56. This embodiment can be provided both in the case of a diameter increase and in the case of a through sleevelike extension part 50 or 54.

In order to obtain a better and more uniform appearance of the wrapping sheet 26, the extended wrapping sheet 26' and an additional further wrapping sheet 56', said parts can be made from a uniform material and connected by a preset breaking point 58, as shown in FIG. 7.

This embodiment not only has the advantage of a better optical appearance, but also facilitates and improves manufacture, whereby wrapping sheet 26, extended wrapping sheet 26' and further wrapping sheets 56 or 56' can be applied to the filter cigarette in one operation.

As a result of a simple rotary movement in the outer area of the wrapping sheet 56', i.e. on the outer end of the mouthpiece, the preset breaking point is severed and a corresponding rotary movement made possible.

According to a further preferred embodiment, the blocking means are provided which only permit a limited movement of rotary sleeve 30, namely from a position in which the openings or recesses 36 of bottom surface 32 with the outlets 25 of the groove-like channels are in the through position to a further completely closed position in which, as shown in FIG. 1, no secondary or admixed air enters. These blocking means can, as shown in FIG. 8, comprise a part ring-shaped projection or a nose-like projection 60, which engages in a corresponding part ring-shaped slot 62.

Preferably, a plurality of reciprocally spaced noses 60 are provided on the inner face of the extended wrapping sheet 26' and they engage in correspondingly shaped part ring-shaped nut 62.

Other blocking beams are also possible. It is appropriate to provide markings indicating the complete through position and/or the closed position for the ventilation air on the outer face of the sleeve-like extension 50 or on the further wrapping sheet 56, 56' covering said extension, as well as on the outside of the extended wrapping sheet 26'.

Further modifications are also possible. Thus, for example, the air-impermeable sleeve 22 can be given a slight air permeability. In addition, the groove-like channels can extend up to the tobacco-side end of the filter core 20, and it is also possible to provide further chambers with other filter materials in the vicinity of the filter body.

What is claimed is:

1. A filter cigarette having a generally cylindrically shaped filter body at one end thereof having a substantially air impermeable sleeve surrounding said filter body, said filter body having an exterior surface and a plurality of channel means formed in said exterior surface with said channel means being circumferentially spaced apart, wrapping sheet means surrounding said filter body and having at least a portion thereof permeable to the air, each said channel means having a first end in communication with the air through a said portion of said wrapping sheet means and a second end disposed for flow communication with the mouth of the user, said wrapping sheet means including an end portion, a cup-shaped member rotatably disposed in said end portion, said cup-shaped member having an end wall having a plurality of circumferentially spaced openings and a central opening in flow communication with said filter body, said spaced openings being disposed radially outwardly of said central opening a distance such that said spaced openings can be moved into and out of registry with a selected second end of a respective said channel means upon rotation of said cup-shaped member relative to said wrapping sheet means.

2. The filter cigarette as claimed in claim 1 wherein said cup-shaped member has a circumferential side wall extending from said end wall with said side wall having an annular slot formed therein and on the exterior of said circumferential side wall, said end portion of said wrapping sheet means having means for engaging said slot.

3. The filter cigarette as claimed in claim 2 wherein said cup-shaped member is at least partially filled with filter material.

4. The filter cigarette as claimed in claim 1 wherein said central opening in said end wall of said cup-shaped member is connected with said spaced openings.

5. The filter cigarette as claimed in claim 1 wherein said cup-shaped member has a circumferential side wall having an extending portion extending beyond said wrapping sheet.

6. The filter cigarette as claimed in claim 5 wherein said extending portion is tubular and has a diameter slightly greater than the diameter of said cup-shaped member located within said wrapping sheet and an external diameter substantially equal to the external diameter of said wrapping sheet means.

7. The filter cigarette as claimed in claim 6 wherein said extending portion is covered by an additional wrapping sheet means separate from said wrapping sheet means.

8. The filter cigarette as claimed in claim 7 wherein said additional wrapping sheet means is connected to said wrapping sheet means by means of a breakable connection.

9. The filter cigarette as claimed in claim 5 wherein said extending portion is covered by an additional wrapping sheet means separate from said wrapping sheet means.

10. The filter cigarette as claimed in claim 9 wherein blocking means are provided for limiting relative rotational movement of said cup-shaped member relative to said wrapping sheet means.

11. The filter cigarette as claimed in claim 10 wherein said blocking means includes projection means on one of said wrapping sheet means and said cup-shaped member and a slot means on the other of said means and said member, said slot means having opposite ends engageable by said projection means for stopping relative rotation between said cup-shaped member and said sheet means.

12. The filter cigarette as claimed in claim 11 wherein said projection means are provided on the interior of said wrapping sheet means.

13. The filter cigarette as claimed in claim 12 wherein a plurality of said blocking means are provided.

14. The filter cigarette as claimed in claim 9 wherein said extending portion has an outer face carrying markings for indicating the position of said spaced openings of said cup-shaped member relative to said channel means.

* * * * *